US009897402B2

(12) United States Patent
Pettit et al.

(10) Patent No.: US 9,897,402 B2
(45) Date of Patent: Feb. 20, 2018

(54) MAGAZINE WELL EXTENSION AND TRIGGER GUARD EXTENSION FOR A FIREARM

(71) Applicant: Lancer Systems L.P., Quakertown, PA (US)

(72) Inventors: Matthew Pettit, Breinigsville, PA (US); Scott Vilardi, Alburtis, PA (US); Kasimere McManus, Quakertown, PA (US); Scott Michael Kratzer, Schnecksville, PA (US)

(73) Assignee: Lancer Systems L.P., Quakertown, PA (US)

( * ) Notice: Subject to any disclaimer, the term of this patent is extended or adjusted under 35 U.S.C. 154(b) by 0 days.

(21) Appl. No.: 14/414,637

(22) PCT Filed: Jul. 10, 2014

(86) PCT No.: PCT/US2014/046191

§ 371 (c)(1),
(2) Date: Jan. 13, 2015

(87) PCT Pub. No.: WO2015/006583

PCT Pub. Date: Jan. 15, 2015

(65) Prior Publication Data

US 2016/0273857 A1 Sep. 22, 2016

Related U.S. Application Data

(60) Provisional application No. 61/844,749, filed on Jul. 10, 2013.

(51) Int. Cl.

| | |
|---|---|
| ***F41A 3/66*** | (2006.01) |
| ***F41A 19/11*** | (2006.01) |
| ***F41A 9/61*** | (2006.01) |

(52) U.S. Cl.
CPC *F41A 3/66* (2013.01); *F41A 9/61* (2013.01); *F41A 19/11* (2013.01)

(58) Field of Classification Search
CPC ..... F41A 9/00; F41A 9/59–9/61; F41A 9/63–9/66; F41A 9/71; F41A 9/82–9/84;
(Continued)

(56) References Cited

U.S. PATENT DOCUMENTS 2,750,700 A * 6/1956 Harvey ..... F41A 11/00 42/69.01
2,912,781 A * 11/1959 Lizza ..... F41A 11/00 42/69.01

(Continued)

FOREIGN PATENT DOCUMENTS

JP 3179041 U 10/2012
WO 2010042262 A2 4/2010

OTHER PUBLICATIONS

International Search Report and Written Opinion of the International Searching Authority (ISA/KR), dated Oct. 30, 2014, for PCT/US2014/046191.

*Primary Examiner* — Stephen Johnson
*Assistant Examiner* — Benjamin S Gomberg
(74) *Attorney, Agent, or Firm* — Design IP

(57) ABSTRACT

The present application teaches an improved magazine well extension and trigger guard extension for a firearm.

5 Claims, 8 Drawing Sheets

(58) Field of Classification Search
CPC ..... F41A 11/02; F41A 35/00; F41A 17/38; F41A 19/11; F41A 3/66; F41C 23/10; F41C 23/14; F41C 27/00
USPC ... 42/6, 7, 49.01–49.02, 50, 87, 90, 97, 106, 42/146; 89/33.01, 33.1, 1.1
See application file for complete search history.

(56) References Cited

U.S. PATENT DOCUMENTS 4,499,683 A * 2/1985 Savioli ..... F41A 19/09 42/69.01
4,520,585 A * 6/1985 Barrett ..... F41C 23/10 42/7
4,528,765 A 7/1985 Johnson
4,685,379 A * 8/1987 Troncoso ..... F41A 19/02 42/69.01
6,164,000 A * 12/2000 Lumplecker ..... F41A 9/71 42/17
7,117,622 B2 * 10/2006 Freed ..... F41A 9/65 42/50
7,743,542 B1 * 6/2010 Novak ..... F41C 23/10 42/49.02
7,823,312 B2 * 11/2010 Faifer ..... F41A 9/61 42/49.02
8,127,480 B1 * 3/2012 McManus ..... F41A 9/61 42/49.02
8,533,987 B2 * 9/2013 Rogers ..... F41C 23/16 42/72
8,726,554 B2 * 5/2014 Klassen ..... F41A 9/71 42/6
9,003,685 B1 * 4/2015 Huang ..... F41A 19/11 42/70.07
9,217,617 B1 * 12/2015 Mapes ..... F41A 17/38
D751,165 S * 3/2016 Miller ..... D22/108
2005/0183317 A1 * 8/2005 Finn ..... F41A 19/11 42/72
2010/0154275 A1 6/2010 Faifer
2011/0173859 A1 * 7/2011 Findlay ..... F41A 19/11 42/69.01
2012/0073176 A1 3/2012 McManus et al.
2013/0104440 A1 * 5/2013 Addis ..... F41A 17/38 42/90
2013/0180143 A1 * 7/2013 Delgado Acarreta ..... F41A 9/71 42/1.02
2014/0230297 A1 * 8/2014 Larson, Jr. ..... F41A 17/38 42/6

* cited by examiner

MAGAZINE WELL EXTENSION AND TRIGGER GUARD EXTENSION FOR A FIREARM

FIELD OF THE INVENTION

The present invention relates to accessories for firearms, and more specifically to a magazine well extension and trigger guard extension for firearms.

BACKGROUND OF THE INVENTION

Firearm magazines are typically inserted into a firearm via a magazine well ("magwell"), which typically has an opening that extends to the bottom side of the firearm. Magwells are often designed with strict tolerances in relation to the appropriate magazine, such that the magazine must be carefully aligned with the magwell opening before the magazine may be inserted into the magwell. During combat or other stressful situations, it can be difficult to replace the magazine quickly.

Known solutions to this problem are magazine well adapters that attach to a firearm and provide an enlarged opening and a "funnel" shape that assists the user with feeding the magazine into the magwell opening of the firearm. The sloped (feed) walls of known magwell extensions are subject to wear over time due to repeated contact with the magazine that is being fed into the magwell, and therefore in most cases the entire magwell extension must eventually be replaced. This presents a substantial cost burden because, in these devices, the entire assembly must be removed from the magwell and discarded. Further, many existing magwell extensions fit onto the magwell via a friction fit only. This requires magwell extensions to have very specific tolerances, thereby increasing their productions cost.

Further, for users with larger hands or that wear gloves while operating a firearm, the size and configuration of existing firearm trigger guard assemblies can be a hindrance to proper use of the firearm.

There is a continued need for improved magwell adapters that assist a firearm user in feeding a magazine into a magazine well of the firearm. Further, there is a need for devices that improve the trigger guard assemblies of existing firearms.

ASPECTS OF THE INVENTION

Additional aspects of the invention include:

Aspect 1: An extension for a firearm, the firearm comprising a lower receiver having a magazine well, a trigger guard, a rear trigger guard attachment point and a front trigger guard attachment point, the magazine well having a front side, a rear side and a bottom end comprising a first lower opening having a first area, the trigger guard having a front end and a rear end, the extension comprising: a first component; and a second component having a second lower opening that is monolithic; wherein one of the first and second components is shaped to engage front side of the magazine well when the first and second components are positioned around the bottom end of the magazine well and secured to each other and the other of the first and second components is shaped to engage the rear side of the magazine well when the first and second components are positioned around the bottom end of the magazine well.

Aspect 2: The extension of aspect 1, further comprising two fasteners, the first component including a first fastener-engaging member located on a left side of the lower receiver when the first and second components are secured to the bottom end of the magazine well and a second fastener-engaging member located on a right side of the lower receiver when the first and second components are secured to the bottom end of the magazine well, the second component including a third fastener-engaging member located on the left side of the lower receiver when the first and second components are secured to the bottom end of the magazine well and a fourth fastener-engaging member located on the right side of the lower receiver when the first and second components are secured to the bottom end of the magazine well, wherein the first and third fastener-engaging members are shaped and positioned to draw the first and second components together when the first fastener is tightened and the second and fourth fastener-engaging members are shaped and positioned to draw the first and second components together when the second fastener is tightened.

Aspect 3: The extension of any of the aspects 1-2, wherein at least one of the first and second components has a locating member that is shaped and positioned to engage a machined surface located on the lower receiver.

Aspect 4: The extension of any of the aspects 1-3, wherein the second lower opening has a second area that is larger than the first area.

Aspect 5: The extension of any of the aspects 1-4, one of the first component and second component further comprising at least one aperture that is positioned to be attached to the front end of the trigger guard without disconnecting the rear end of the trigger guard from the firearm.

Aspect 6: The extension of aspect 5, wherein the front end of the trigger guard is positioned lower when it is attached to at least one aperture and the extension is installed on the magazine well than when the front end of the trigger guard is attached to a front trigger guard attachment point of the lower receiver.

Aspect 7: The extension of any of the aspects 5-6, wherein one of the first component and second component further comprises at least one aperture that is positioned to engage with a hole located on the a front trigger guard attachment point when the extension is installed on the magazine well.

Aspect 8: The extension of any of the aspects 1-7, wherein one of an upper side of the second component and a lower side of the first component comprises at least one pin and the other of the upper side of the second component and a lower side of the first component comprises at least one groove, and the pin engages the groove when the extension is assembled.

Aspect 9: The extension of any of the aspects 1-7, wherein the second component has a plurality of walls that extend from the second lower opening to the first lower opening when the extension is installed on the magazine well so that when magazine is inserted into the magazine well or removed from the magazine well, the magazine does not come into contact with the first component.

Aspect 10: A method of modifying a firearm, the firearm comprising a lower receiver having a magazine well and at least one machined surface, the magazine well having a first lower opening, a front side and a rear side, the method comprising: providing a second lower opening that is located below the first lower opening by securing a first component a magazine well extension to a second component of the magazine well extension; and positioning the magazine well extension relative to the magazine well by engaging the at least one machined surface with a portion of the magazine well extension.

Aspect 11: The method of aspect 10, wherein the providing step further comprises providing a second lower opening that is larger than the first lower opening.

Aspect 12: The method of any of the aspects 10-11, wherein the positioning step further comprises positioning the magazine well extension relative to the magazine well by engaging a machined surface of a front trigger guard attachment point located on the lower receiver.

Aspect 13: The method of any of the aspects 10-12, wherein the positioning step further comprises positioning the magazine well extension relative to the magazine well by engaging the front side of the magazine well.

Aspect 14: A method of installing a magazine well extension onto a firearm, the firearm comprising a magazine well and a trigger guard, the magazine well having a bottom end comprising a flange, the flange having a lower surface and an opposing surface, the trigger guard having a front end and a rear end, the method comprising: attaching a first component of the magazine well extension to a second component of the magazine well extension; and attaching one of the first component or the second component to the flange.

Aspect 15: The method of aspect 14, further comprising tightening the magazine well extension against the flange by extending a member through a surface of at least one of the first component and the second component and into contact with the flange.

Aspect 16: The method of aspect 15, wherein the step of tightening the magazine well extension against the flange further comprises extending a threaded member through a surface of at least one of the first component and the second component such that it contacts the opposing surface of the flange.

Aspect 17: The method of any of the aspects 15-16, wherein the step of tightening the magazine well extension against the flange causes one of the first component and the second component to come into contact with the lower surface of the flange.

Aspect 18: The method of any of the aspects 14-17, further comprising sliding one of the first component and the second component over the flange from a front end of the flange.

Aspect 19: The method of aspect 18, further comprising sliding the other of the first component and the second component over the flange from a rear end of the flange.

Aspect 20: The method of any of the aspects 14-20, further comprising lowering a position of the front end of the trigger guard and attaching the front end of the trigger guard to one of the first component and the second component without detaching the rear end of the trigger guard from the firearm.

Aspect 21: The method of aspect 20, further comprising attaching one of the first component and second component to at least one aperture that is positioned to engage a hole located on the firearm to which the front end of the trigger guard is engaged when the magazine well extension is not installed on the magazine well.

Aspect 22: An extension for a magazine well of a firearm, the magazine well having a bottom end, the extension comprising: a component comprising an exterior surface and an interior surface, the interior surface including a slot that is sized and shaped to mate with the bottom end of the magazine well and at least one hole that passes through the flange-mounting mounting portion between the exterior surface and the interior surface; wherein when the component is attached to the magazine well via mating of the slot with the bottom end of the magazine well, a member can be passed through the at least one hole and into contact with the bottom end of the magazine well, thereby tightening the component against the magazine well.

Aspect 23: The extension of aspect 22, wherein the at least one hole and the member are threaded.

Aspect 24: An extension for a magazine well of a firearm, the magazine well having a bottom end comprising a flange and a well opening for receiving a magazine, the extension comprising: a flange-mounting component that is attachable to the flange of the magazine well and supports the extension from the magazine well when connected thereto; and a magazine-receiving component that is attachable to the flange-mounting component, the magazine-receiving component including a lower opening for receiving the magazine; wherein when the flange-mounting component is attached to the flange and the magazine-receiving component is attached to the flange-mounting component, a magazine-receiving passage is formed between the lower opening of the magazine-receiving component and the well opening of the magazine well of the firearm, wherein the flange-mounting component forms no portion of the magazine-receiving passage.

Aspect 25: The extension of aspect 24, wherein the lower opening in the magazine-receiving component has an area that is larger than an area of the well opening.

Aspect 26: The extension of aspect 25, wherein an upper opening in the magazine-receiving component has an area that is equal to the area of the well opening.

Aspect 27: An accessory for a firearm, the firearm comprising a magazine well and a trigger guard having a front end that is attachable to a front trigger guard mounting hole located on the firearm and a rear end that is attachable to a rear trigger guard mounting hole located on the firearm, the accessory comprising: a component that is attachable to the magazine well of the firearm, the component further comprising a first part that is attachable to the front trigger guard mounting hole and a second part that is attachable to the front end of the trigger guard; wherein when the component is attached to the magazine well, the first part is attached to the front trigger guard mounting hole, and the second part is attached to the front end of the trigger guard, the front end of the trigger guard is located below the front trigger guard mounting hole.

Aspect 28: The accessory of aspect 27, wherein the component is attachable to the magazine well of the firearm by sliding the component over a flange located on an exterior of a bottom end of the firearm.

Aspect 29: A method of expanding the area of a trigger opening of a firearm, the firearm comprising a magazine well and a trigger guard having a front end that has been detached from a front trigger guard mounting hole located on the firearm and a rear end that is attached to a rear trigger guard mounting hole located on the firearm, the method comprising: attaching a component to the magazine well, the component further comprising a first part that is attachable to the front trigger guard mounting hole and a second part that is attachable to the front end of the trigger guard; attaching the first part to the front trigger guard mounting; and attaching the second part to the front end of the trigger guard such that the front end of the trigger guard is located below the front trigger guard mounting hole.

BRIEF DESCRIPTION OF THE DRAWINGS

The foregoing summary, as well as the following detailed description of the invention, will be better understood when read in conjunction with the appended drawings. For the purpose of illustrating the invention disclosed herein, certain embodiments in accordance with the herein disclosed invention are shown in the drawings. It should be understood, however, that the herein disclosed invention is not limited to the precise arrangements shown. It should also be understood that, in the drawings, the parts are not necessarily drawn to scale. The present invention will hereinafter be described in conjunction with the appended drawing figures, wherein like numerals denote like elements. In the drawings.

DETAILED DESCRIPTION OF THE PREFERRED EMBODIMENTS

Figure 1:
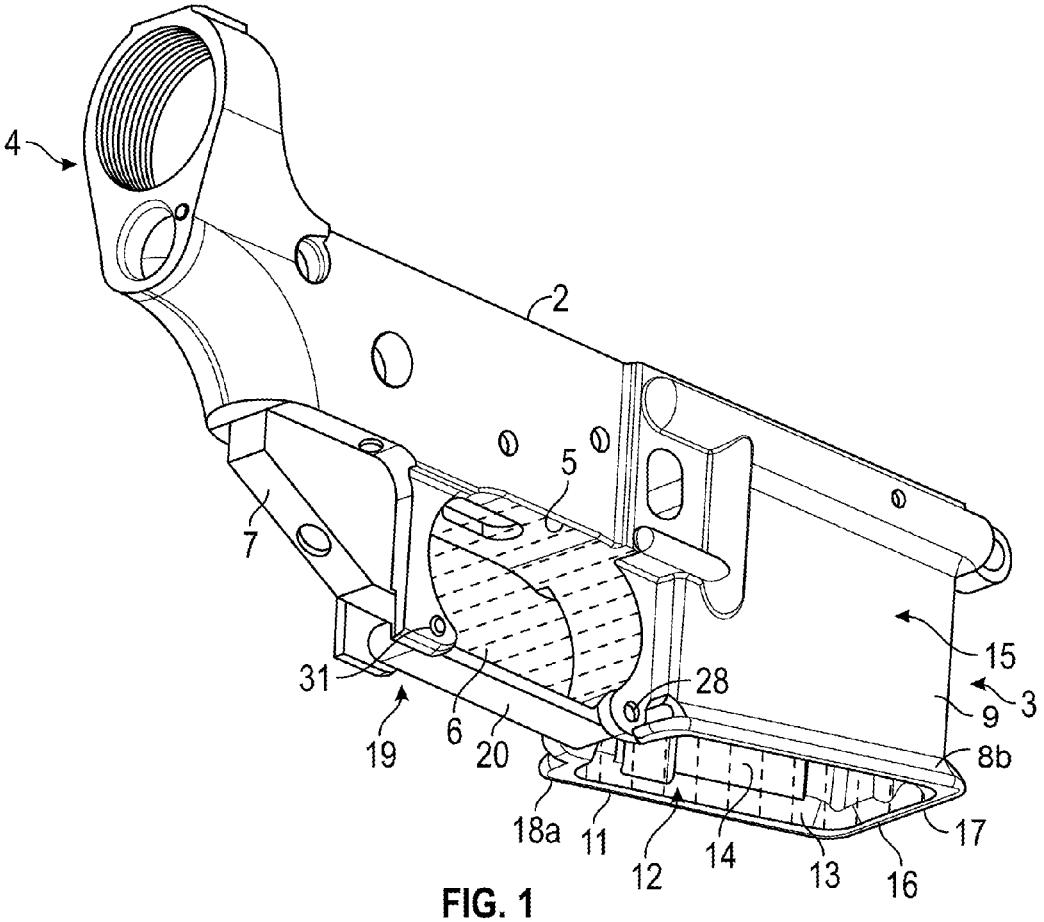
FIG. 1 (Prior Art)
FIG. 1 is a front perspective view of a lower receiver and trigger guard assembly for a firearm in accordance with the prior art.

The ensuing detailed description provides preferred exemplary embodiments only, and is not intended to limit the scope, applicability, or configuration of the herein disclosed inventions. Rather, the ensuing detailed description of the preferred exemplary embodiments will provide those skilled in the art with an enabling description for implementing the preferred exemplary embodiments in accordance with the herein disclosed invention. It should be understood that various changes may be made in the function and arrangement of elements without departing from the spirit and scope of the invention, as set forth in the appended claims.

To aid in describing the invention, directional terms may be used in the specification and claims to describe portions of the present invention (e.g., upper, lower, left, right, etc.). These directional definitions are merely intended to assist in describing and claiming the invention and are not intended to limit the invention in any way. When referring to an element that is a component of a firearm and unless otherwise specified, the front of a part of a firearm faces the barrel end of the firearm and the rear of a part of a firearm faces the butt-end of the firearm.

Reference numerals that are introduced in the specification in association with a drawing figure may be repeated in one or more subsequent figures without additional description in the specification in order to provide context for other features.

The term "monolithic" as used in the specification and claims means that the feature being described as monolithic is formed from a single piece of material, as opposed to being formed by the assembly of multiple parts.

Referring generally to FIGS. 1-9, an embodiment of a magazine well extension (hereinafter "magwell extension") 40 that is attachable to a prior art lower receiver 2 of a firearm will be described in detail. FIG. 1 shows a prior art lower receiver 2 of a firearm in accordance with the prior art. The lower receiver 2 shown in FIG. 1 is from a model AR-15 rifle produced by Colt's Manufacturing Company of Hartford, Conn., U.S.A. It should be understood that the present invention could be adapted to be used with any number of firearm makes, models, and types, including but not limited to handguns, rifles, shotguns, and carbines, as will be discussed in further detail below.

The prior art lower receiver 2 shown in FIG. 1 comprises a front side 3 that corresponds with the front (i.e., barrel) side of an assembled firearm, a rear side 4 that corresponds with the rear (i.e., buttstock) side of an assembled firearm, a grip-mounting portion 7 to which a handgrip may be attached, a trigger opening 5 having an area 6, and a magazine well (hereinafter "magwell") 9 into which a magazine is inserted. The magwell 9 includes a top end 10 (see FIG. 3), a bottom end 11, a lower opening 12 having an area 13, an interior 14, and an exterior 15. Located around the bottom end 11 of the magwell 9, on the exterior 15 thereof, is a flange 16 including a front portion 17 and a pair of side portions 18*a*,18*b*.

Figure 2:
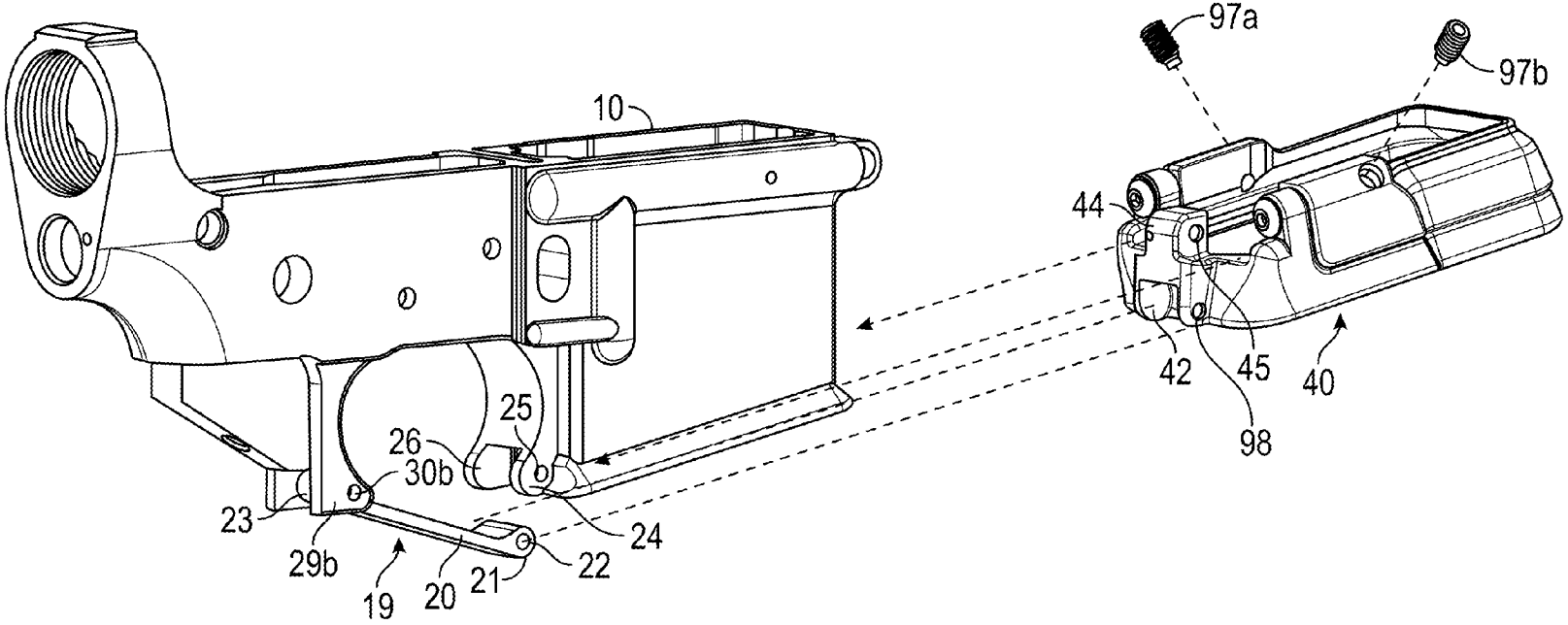
FIG. 2 is a partial exploded view of a first embodiment of a magazine well extension according to the present invention shown in relation to the prior art lower receiver and trigger guard assembly of FIG. 1.

Also shown in FIG. 1 is a prior art trigger guard assembly 19 of the lower receiver 2. The trigger guard assembly 19 comprises a trigger guard 20 that—in its standard configuration according to the prior art—is attached directly to the lower receiver 2 in two locations to complete the trigger opening 5. As shown in FIGS. 1 and 2, in said standard position a front end 21 of the trigger guard 20 is attached to a front ear 24 via a spring-loaded pin 28 that is inserted into a hole 22 located at the front end 21 of the trigger guard 20. The spring-loaded pin 28 includes a spring and a plunger or detent portion (not shown or labeled in FIGS. 1-9). The detent portion extends into a throughhole 25 located in a front ear 24. The lower receiver 2 also includes a front ear 26, which is in contact with the opposing side of the front end 21 of the trigger guard 20. The rear end 23 of the trigger guard 20 is attached to a pair of rear ears 29*a*,29*b* via a roll pin 31 that is inserted through a throughhole (not shown or labeled) that is located at the rear end 23 of the trigger guard 20 and pressed into throughholes 30*a*,30*b* that are located, respectively, in the rear ears 29*a*,29*b*.

Figures 10, 11:
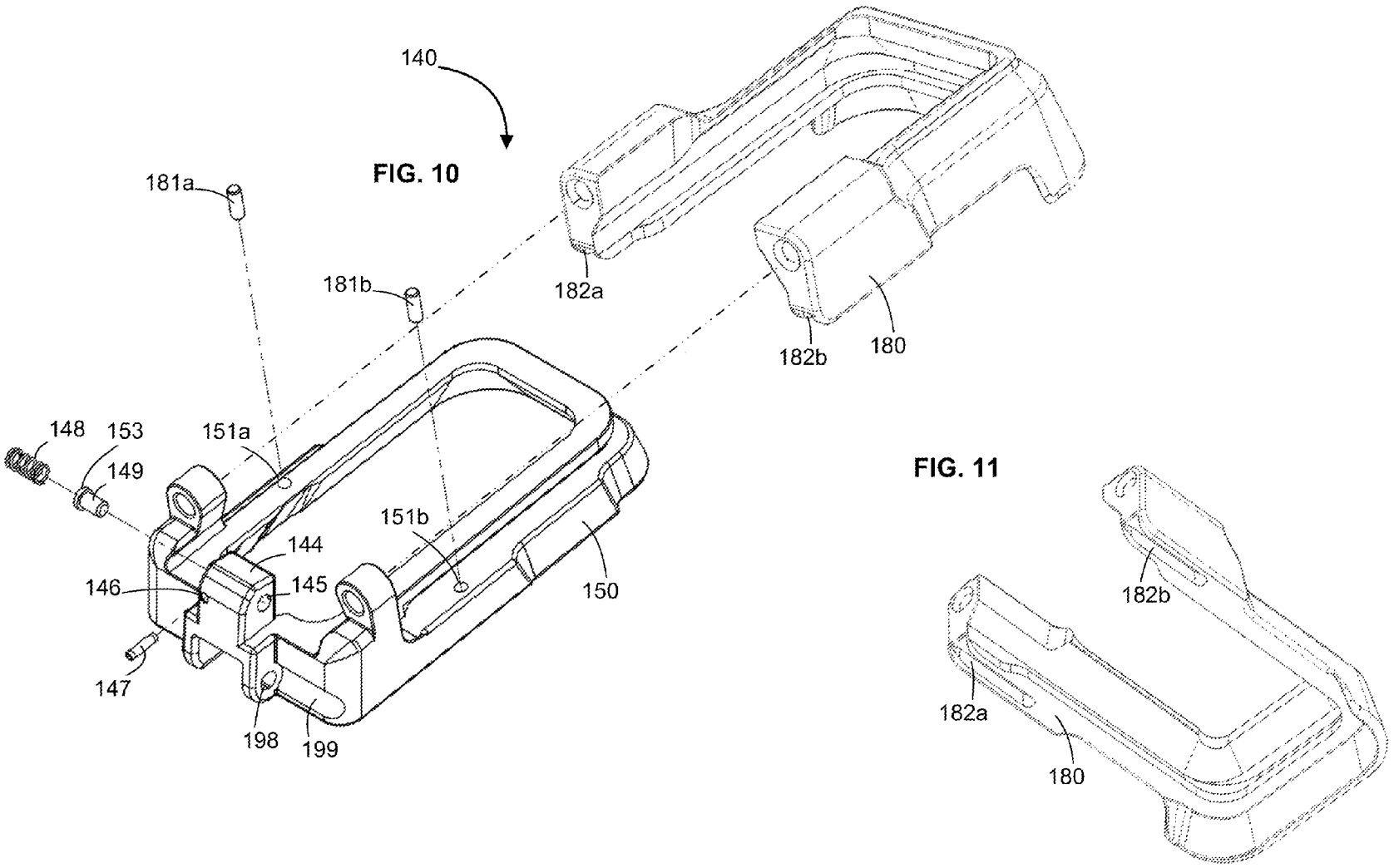
FIG. 10 is an exploded view of a second embodiment of a magazine well extension according to the present invention.
FIG. 11 is a bottom perspective view of the magazine-receiving component of the embodiment of FIG. 10.

FIG. 2 is a partial exploded view showing the manner in which the magwell extension 40 according to the present invention is connected to the prior art magwell 9 and attached to the prior art trigger guard assembly 19. In order to attach the trigger guard 20 to the magwell extension 40, the spring-loaded pin 28 is depressed from the throughhole 25 and the front end 21 of the trigger guard 20 is rotated downwardly about the roll pin 31, which remains installed in the trigger guard 20 and lower receiver 2. The front end 21 of the trigger guard 20 is thus located below the front ears 24,26. Once the magwell extension 40 has been installed over the portions 17,18*a*,18*b* of the flange 16, as will be described in further detail below, the front end 21 of the trigger guard 20 is attached to a trigger guard attachment portion 42 of the magwell extension 40 via the spring-loaded pin 28, which mates with a hole 98 located in a side of the trigger guard attachment portion 42. The lower receiver 2 is further secured to the magwell extension 40 by attaching an ear attachment portion 44 of the magwell extension 40 to the front ear 24 via a spring-loaded pin, which is inserted into a hole 45 located on the ear attachment portion, and held in place within the hole 45 via a roll pin that is inserted through roll pin hole 46 located on the front side of the ear attachment portion 44 and perpendicularly enters the hole 45. The embodiment of FIG. 10 shows a roll pin 147, a spring 148, and a detent portion 149. The spring 148 and detent portion 149 collectively comprise the spring-loaded pin that secures the ear attachment portion 144 to the front ear of the lower receiver 2. It should be understood that the spring-loaded pin (including spring 148 and detent portion 149) and roll pin 147 of the embodiment of FIGS. 10 and 11 are identical to the parts that are used in the embodiment of FIGS. 1-9 to secure the ear attachment portion 44 to the front ear 24.

Figure 3:
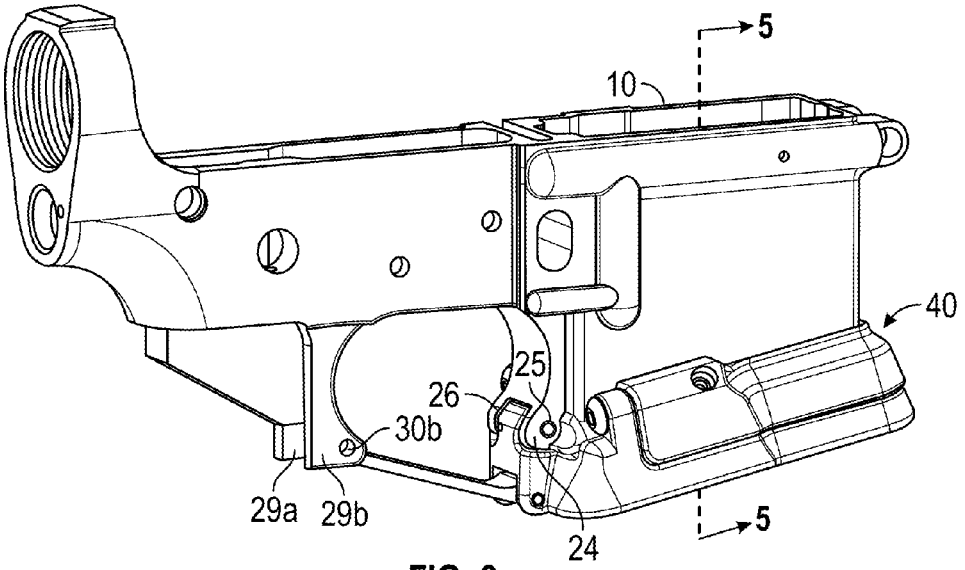
FIG. 3 is a left side perspective view of the embodiment of FIG. 2 shown installed on the prior art lower receiver of FIG. 1.
Figure 4:
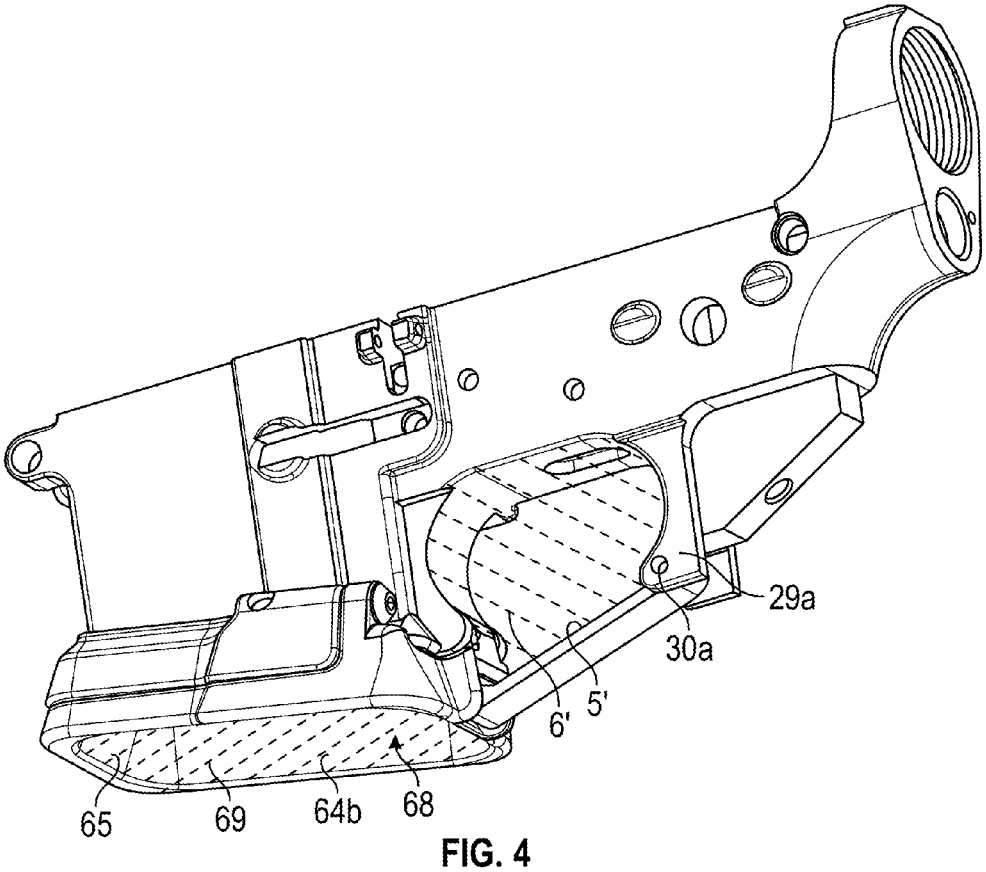
FIG. 4 is right side perspective view thereof.
Figure 5:
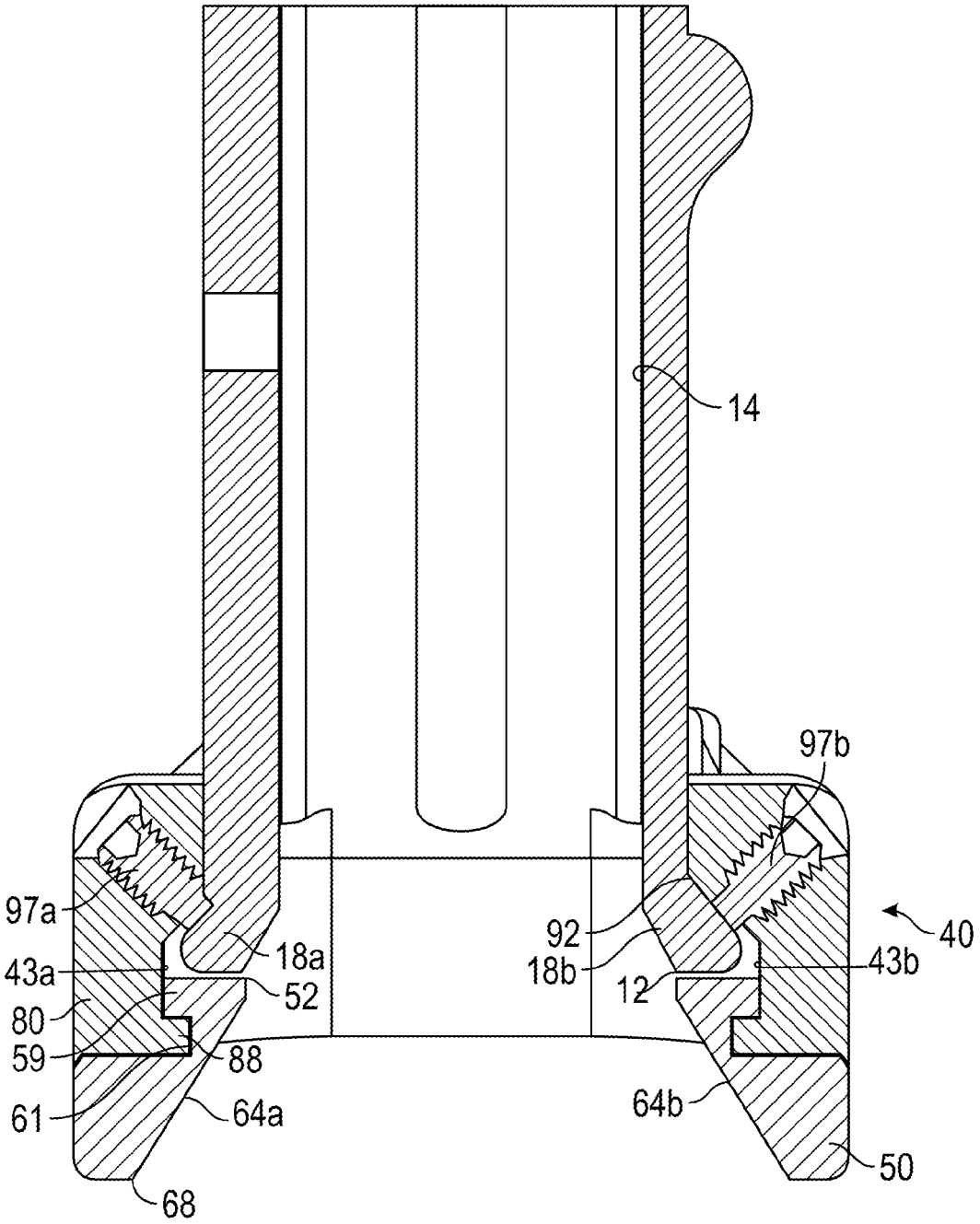
FIG. 5 is a sectional view taken along line 5-5 of FIG. 3.
Figure 6:
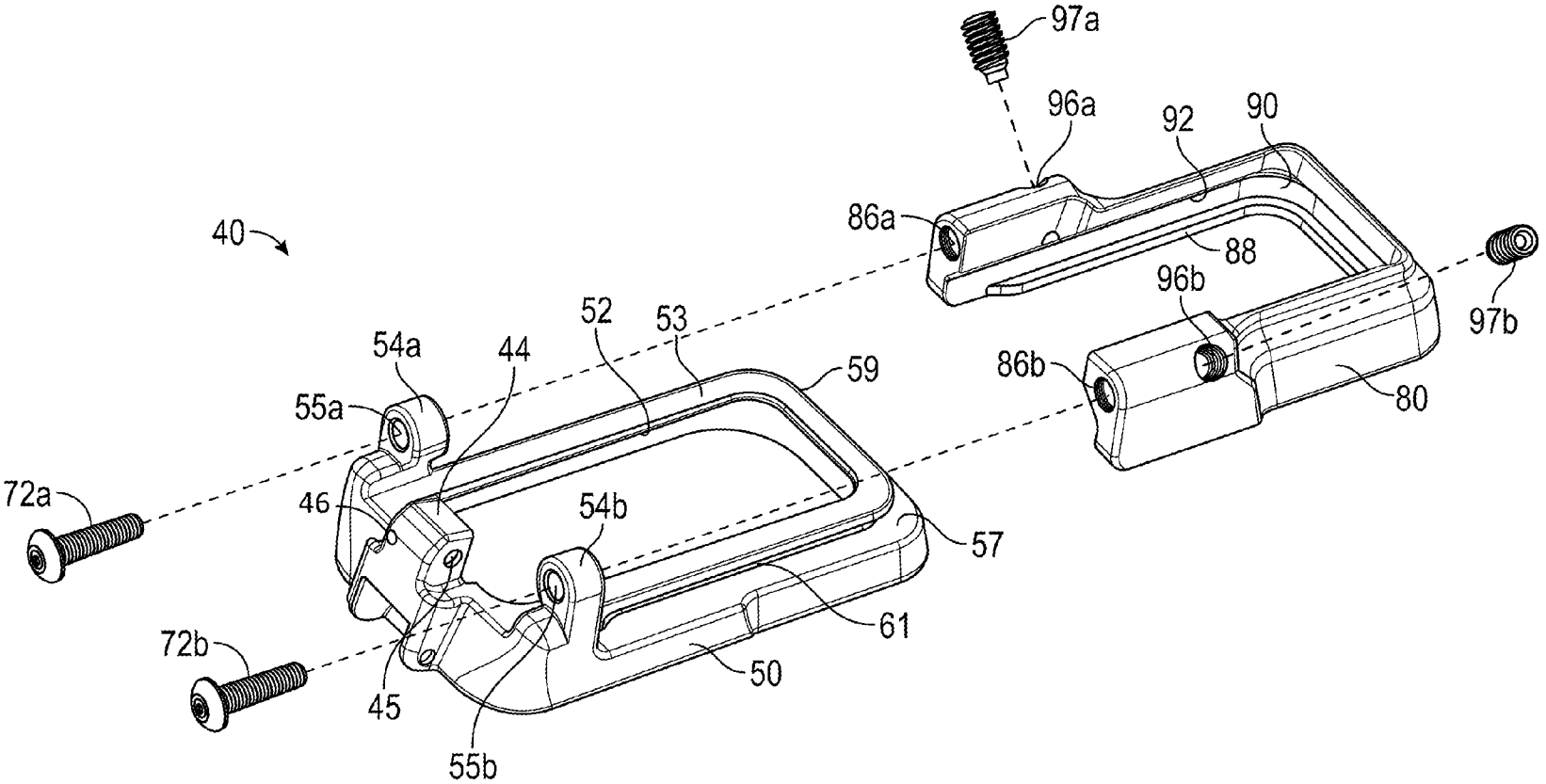
FIG. 6 is an exploded view of the embodiment of FIG. 2.
Figure 7:
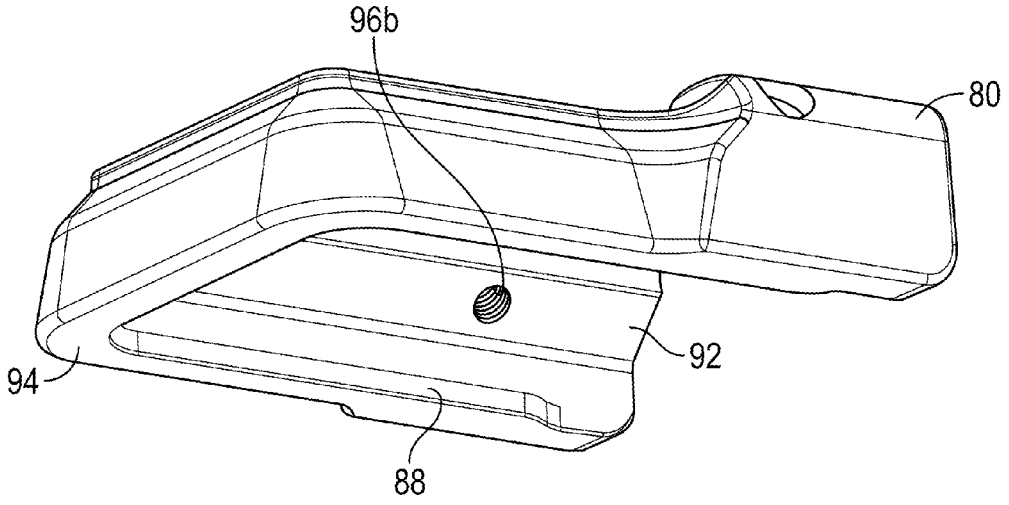
FIG. 7 is a bottom perspective view of the flange-mounting component of the embodiment of FIG. 2.
Figure 8:
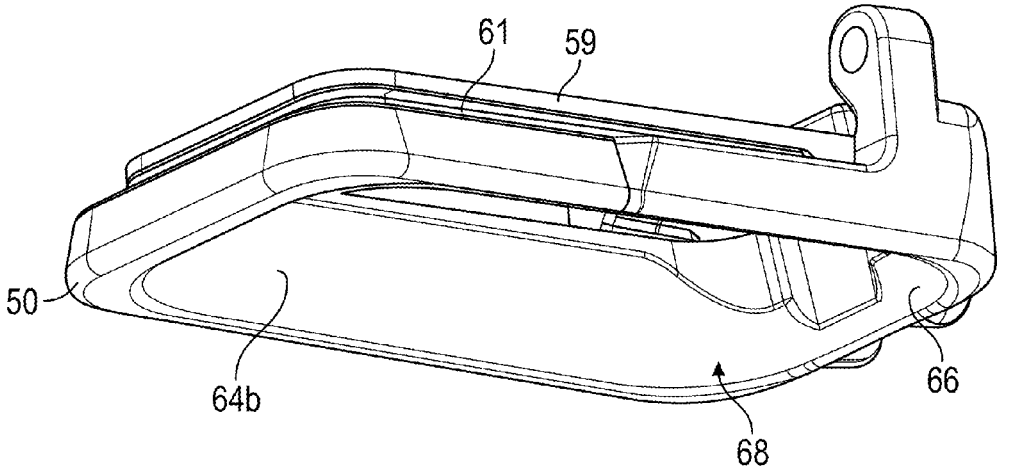
FIG. 8 is a bottom perspective view of the magazine-receiving component of the embodiment of FIG. 2.
Figure 9:
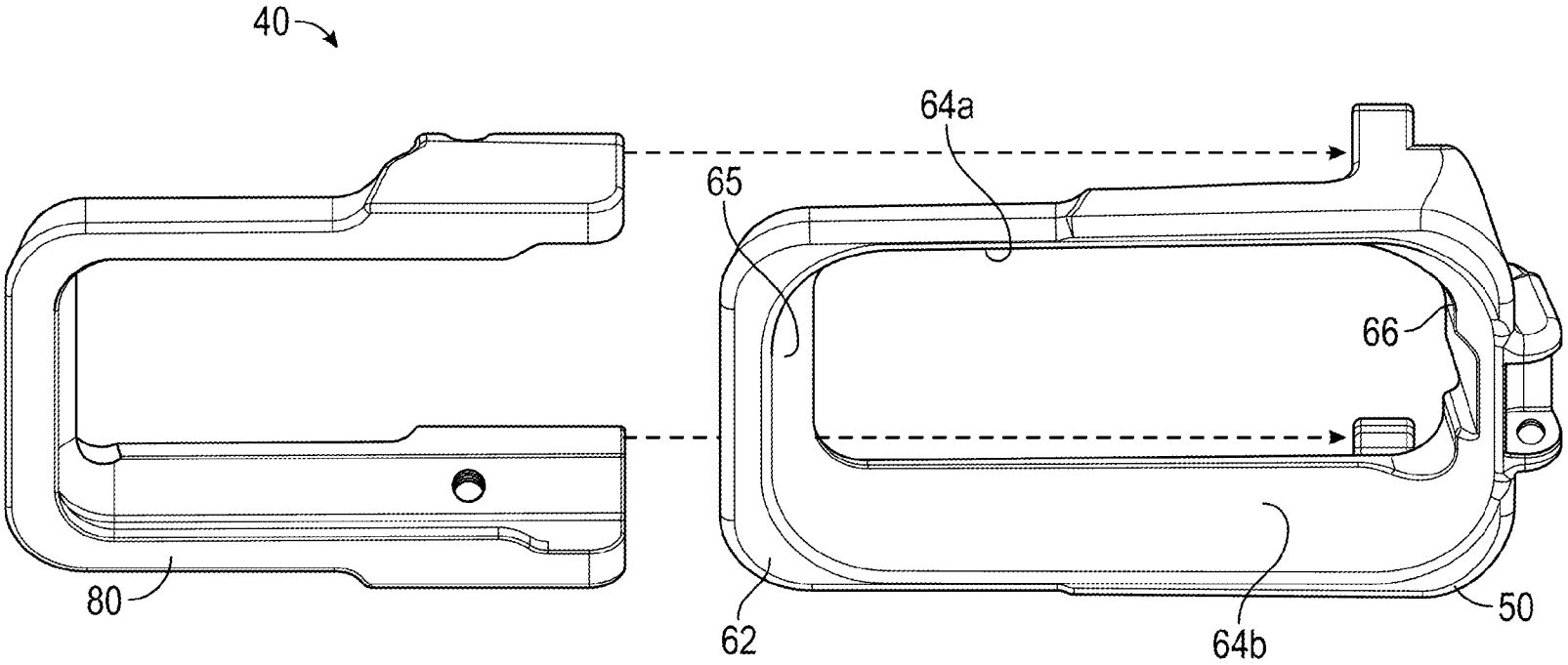
FIG. 9 is a partial exploded view of the embodiment of FIG. 2, showing the bottom surfaces of components thereof.

FIGS. 3 and 4 show side views of the magwell extension 40 according to the present invention shown installed on the prior art AR-15 lower receiver 2. As shown in these figures, when the magwell extension 40 is fully installed and the trigger guard 20 has been attached to the magwell extension 40 as discussed above, a trigger opening 5' having an area 6' is provided. The trigger opening 5' has an area 6' that is greater than the area 6 of the trigger opening 5 (see FIG. 1). This provides the firearm user with additional volume within the trigger opening 5' in which to insert their trigger finger. In this way, the magwell extension 40 provides a trigger guard extension that is an improvement over known prior art trigger guard assemblies.

As shown in FIGS. 5-9, the magwell extension 40 comprises two primary parts, a flange-mounting component 80 that attaches directly to the flange 16 of the magwell 9 of the lower receiver 2, and a magazine-receiving component 50 that attaches to the flange-mounting component 80. In this embodiment, the magazine-receiving component 50 is not directly attached to the magwell 9 of the lower receiver 2, but rather indirectly attached via the flange-mounting component 80.

As is understood by one of ordinary skill in the art, the sloped (feed) walls of magwell extensions are wear components. In other words, these parts are subject to wear over time due to repeated contact with the magazine that is being fed into and removed from the magwell, and therefore the magwell extension must eventually be replaced. Because many existing magwell extensions are of single-piece construction, replacement presents a substantial cost burden because the entire assembly must be removed from the magwell and discarded. The magwell extension 40 according to the present invention addresses this drawback with prior art magwell extensions by providing the two-part construction discussed herein. In the embodiment of the magwell extension 40 described herein and shown in the accompanying figures, the flange-mounting component 80 is not contacted by the magazine during normal use when the magazine is being inserted into the magwell 9 of the lower receiver, and therefore is not subject to wear that would require its eventual replacement. The magazine-receiving component 50 is the only wear component of the magwell extension 40, and is thus the only part of the magwell extension 40 that will eventually require replacement. Thus, because the magazine-receiving component 50 is only a portion of the magwell extension 40, the costs associated with replacing this part are less than the costs associated with replacing the entire magwell extension 40.

As noted above, the present invention may be used with many different firearms. Different firearm models have different magwell sizes, shapes, and configurations, and therefore it is difficult to design a magwell extension that is universal across all firearm platforms. Accordingly, in the present invention, while the size and shape of specific embodiments of the flange-mounting component 80 must be chosen such that it can be securely attached to the lower receiver(s) with which it is designed to be used, the magazine-receiving component 50 may be designed to fit across a range of firearm platforms, such that one version of the magazine-receiving component could be used with more than one version of the flange-mounting component 80. This reduces the need for users to keep multiple versions of this wear component on hand, and also reduces design and manufacturing costs.

Referring back to FIGS. 1-9, in this embodiment the flange-mounting component 80 comprises a rail 88 located at the bottom side thereof, a sloped surface 92 located towards the top side thereof, and a slot 90 oriented vertically between the rail 88 and the sloped surface 92. Each of the rail 88, slot 90, and sloped surface 92 wrap around the three interior sides of the flange-mounting component 80. The slot 90 and sloped surface 92 are sized and shaped so as to approximately accommodate the placement of the flange-mounting component 80 over the front portion 17 and side portions **18*a*,18*b* of the flange 16 of the magwell 9 of the lower receiver 2. The slot 90 is aligned with the side portions 18*a*,18*b*, and the flange-mounting component 80 is moved in a direction towards the rear side 4 of the lower receiver 2, as approximately shown in FIG. 2**.

Many known magwell extensions are attached to the flange of a magwell via a friction fit only. This requires that the magwell extensions have very careful tolerances so that the magwell extension does not work itself loose during use of the firearm. This increases the costs of manufacturing these devices. Further, due to repeated usage and vibration of the firearm, friction fits alone may be inadequate to maintain accessories attached to a firearm. In order to address this problem, in the embodiment of the magwell extension 40 described herein and shown in FIGS. 1-9, the flange-mounting component 80 is tightened against the side portions **18*a*,18*b* of the flange 16 of the magwell 9 of the lower receiver 2 via set screws 97*a*,97*b* that are each inserted into a respective threaded hole 96*a*,96*b* located in the flange-mounting component 80 and tightened against a respective side portion 18*a*,18*b* of the flange 16 of the magwell 9. In alternate embodiments, other threaded members could be used in the place of the set screws 97*a*,97*b* in order to tighten the flange-mounting component 80 against the flange 16**.

In this embodiment, the magazine-receiving component 50 comprises an upper opening 52 and a lower opening 68 that opposes the upper opening 52. The upper opening 52 extends to a top surface 53 of the magazine-receiving component 50. The lower opening 68 has an area 69. The area (not labeled) of the upper opening 52 is equal or approximately equal to the area 13 of the lower opening 12 of the magwell 9. The magazine-receiving component 50 further comprises a seating surface 57 that comes into contact with a bottom surface 94 of the flange-mounting component 80 when the magazine-receiving component 50 is attached to the flange-mounting component 80 and a lip 59 that defines a groove 61 located between the lip 59 and the seating surface 57. The seating surface 57 opposes a bottom surface 62 of the magazine-receiving component 50. When the flange-mounting component 80 and magazine-receiving component 50 are fitted together, the slot 90 accommodates placement of the lip 59 therein, and the rail 88 fits within the groove 61. The flange-mounting component 80 and magazine-receiving component 50 are then securely attached together by passing connecting bolts **72*a*,72*b* through throughholes 55*a*,55*b* located in bosses 54*a*,54*b* extending from the magazine-receiving component 50 and into threaded holes 86***a*,86*b* located in the flange-mounting component 80.

When the magazine-receiving component 50 and the flange-mounting component 80 are attached together to form the magwell extension 40, spaces 43*a*,43*b* are formed on the interior of the magwell extension 40 that approximately correspond with the side portions 18*a*,18*b* of the flange 16, and an additional space (not shown) is formed on the interior of the magwell extension 40 that approximately corresponds with the front portion 17 of the flange 16. As noted above, the set screws 97*a*,97*b* engage the respective side portions 18*a*,18*b* of the flange 16 at an angle, thereby preventing downward movement of the magwell extension 40. Further, placement of the top surface 53 of the magazine-receiving component 50 just below the flange 16 prevents upward movement of the magwell extension 40, once installed on the magwell 9. These components maintain the position of the magwell extension 40 on the bottom end 11 of the magwell 9.

As noted above, the magazine-receiving component 50 has a lower opening 68 through which the magazine is inserted when the user desires to load the magazine into the magwell 9 of the firearm. In this embodiment, the area 69 of this lower opening 68 is greater than the area 13 of the magwell 9. This enlarged feed area, coupled with a front sloped wall 65, a rear sloped wall 66, and a pair of side sloped walls 64*a*,64*b* that angle between the lower opening 68 and the upper opening 52 of the magazine-receiving component 50—the latter of which is adjacent to and aligned with the lower opening 12 of the magwell 9—aid the user in feeding a magazine into the interior 14 of the magwell 9. As a magazine is placed into the lower opening 68 and pressed upwardly, if not already aligned with the magwell 9 it will ride along one or more of the sloped walls 64*a*,64*b*,65,66 and enter the magwell 9 via the upper opening 52 of the magazine-receiving component 50. In this way, the user can more quickly load a new magazine into the firearm.

As can be seen in FIG. 4, the entire lower opening 68 is defined by the structure of the magazine-receiving component 50. This enables the lower opening 68 to be monolithic, which improves both the performance and durability of the magwell extension 40.

A second embodiment of a magwell extension 140 according to the present invention is shown in FIGS. 10 and 11. In this embodiment, elements shared with the first embodiment (magwell extension 40) are represented by reference numerals increased by a value of 100. For example, ear attachment portion 44 in FIG. 6 corresponds to ear attachment portion 144 in FIG. 10. In the interest of brevity, some features of this embodiment that are shared with the first embodiment are numbered in FIGS. 10 and 11, but are not discussed in the specification.

In the embodiment of FIGS. 10 and 11, the set screws and the threaded holes that are located on the top surface of the flange-mounting component 80 of the first embodiment are omitted. In alternate embodiments according to the embodiment of FIGS. 10 and 11, the set screws and threaded holes could be included. In the embodiment of FIGS. 10 and 11, a pair of pin holes 151*a*,151*b* are provided in the magazine-receiving component 150 into which a pair of pins 181*a*, 181*b* are seated. As shown in FIG. 11, in this embodiment the flange-mounting component 180 includes a pair of pin grooves 182*a*,182*b* on the bottom side thereof. When the flange-mounting component 180 is slid onto the magazine-receiving component 150, the pin grooves 182*a*,182*b* receive the pins 181*a*,181*b* therein. The interaction of the pins 181*a*,181*b* and the pin grooves 182*a*,182*b* helps to maintain the vertical alignment between the flange-mounting component 180 and the magazine-receiving component 150. It should be understood that the pin holes, pins, and pin grooves could also be provided in alternate embodiments according to the embodiment of FIGS. 1-9.

In the embodiment of FIGS. 10 and 11, the magazine-receiving component 150 has a cutout 199 on the rear side thereof in the vicinity of the hole 198, in order to provide access to the hole 198. It should be understood that this cutout 199 could also be provided in alternate embodiments according to the embodiment of FIGS. 1-9.

As summarized above, FIG. 10 illustrates the roll pin 147, which is inserted into the roll pin hole 146 in order to maintain the spring-loaded pin (which is comprised of spring 148 and detent portion 149) within the ear attachment portion 144 of the magazine-receiving component 150. A flanged portion 153 of the detent portion 149 is sized larger than the throughhole 145 so that once the detent portion 149 and spring 148 have been placed into the throughhole 145 and the roll pin 147 has been inserted into the roll pin hole 146 as shown in FIG. 10 such that it engages the throughhole 145, the spring-loaded pin is held captive within the throughhole 145. The detent portion 149 is thus depressible within the hole 145, in order to disengage the spring-loaded pin from the lower receiver 2.

It should be appreciated that the foregoing is presented by way of illustration only, and not by way of any limitation, and that various alternatives and modifications may be made to the illustrated embodiments without departing from the spirit and scope of the present invention.

The invention claimed is:

1. An accessory for a firearm, the firearm comprising a magazine well and a trigger guard having a front end with a front end hole that is attachable to a front trigger guard mounting hole located on the firearm and a rear end that is attachable to a rear trigger guard mounting hole located on the firearm, the accessory comprising:

a component that is attachable to the magazine well of the firearm, the component further comprising a first part that is attachable to the front trigger guard mounting hole and a second part that is attachable to the front end hole of the trigger guard, the second part being located below the first part such that when the component is attached to the magazine well, the first part is attached to the front trigger guard mounting hole, and the second part is attached to the front end hole of the trigger guard, the front end hole of the trigger guard is located below the front trigger guard mounting hole.

2. The accessory of claim 1, wherein the component is attachable to the magazine well of the firearm by sliding the component over a flange located on an exterior of a bottom end of the firearm.

3. The accessory of claim 1, wherein the front end hole of the trigger guard includes a spring-loaded pin, and the second part includes a transverse hole that is sized and shaped to receive the spring-loaded pin when the second part is attached to the front end hole of the trigger guard.

4. The accessory of claim 1, wherein the component includes a plurality of sloped walls that extend below the magazine well when the component is attached to the magazine well, the plurality of sloped walls defining an upper opening proximal to the magazine well and a lower opening distal from the magazine well, the upper opening having an upper opening area and the lower opening having a lower opening area, wherein the lower opening area is greater than the upper opening area.

5. A method of expanding an area of a trigger opening of a firearm, the firearm comprising a magazine well and a trigger guard having a front end with a front end hole that is attachable to a front trigger guard mounting hole located on the firearm and a rear end that is attached to a rear trigger guard mounting hole located on the firearm, the method comprising:

detaching the front end hole of the trigger guard from the front trigger guard mounting hole;

rotating the trigger guard downwardly about the rear trigger guard mounting hole;

attaching a component to the magazine well, the component further comprising a first part that is attachable to the front trigger guard mounting hole and a second part that is attachable to the front end hole of the trigger guard;

attaching the first part to the front trigger guard mounting hole; and attaching the second part to the front end hole of the trigger guard such that the front end of the trigger guard is located below the front trigger guard mounting hole.

* * * * *